US006203101B1

(12) United States Patent
Chou et al.

(10) Patent No.: US 6,203,101 B1
(45) Date of Patent: Mar. 20, 2001

(54) OFFICE CHAIR ARMREST DEVICE

(76) Inventors: Ding-Guo Chou; Guo-Qing Chou, both of No. 127 Guo-Sheng Street, Yungkang, Tainan County (TW)

( * ) Notice: Subject to any disclaimer, the term of this patent is extended or adjusted under 35 U.S.C. 154(b) by 0 days.

(21) Appl. No.: 09/412,670

(22) Filed: Oct. 5, 1999

(51) Int. Cl.[7] ..... A47C 13/00
(52) U.S. Cl. ..... 297/115; 297/411.32; 297/411.38
(58) Field of Search ..... 297/115, 116, 297/411.3, 411.38, 411.35, 411.32

(56) References Cited

U.S. PATENT DOCUMENTS 4,205,879 * 6/1980 Heling ..... 297/411.32
4,466,664 * 8/1984 Kondou ..... 297/411.32 X
4,902,072 * 2/1990 Chancellor, Jr. ..... 297/115 X
5,171,063 * 12/1992 Stidd ..... 297/411.32 X
5,395,160 * 3/1995 Krebs et al. ..... 297/411.3 X
5,597,209 * 1/1997 Bart et al. ..... 297/411.38
5,752,683 * 5/1998 Novis et al. ..... 248/118

* cited by examiner

*Primary Examiner*—Peter M. Cuomo
*Assistant Examiner*—Stephen Vu
(74) *Attorney, Agent, or Firm*—Alan Kamrath; Rider Bennett Egan & Arundel, LLP

(57) ABSTRACT

An office chair armrest device includes two armrests and two L-shaped armrest supporters. Each armrest has a second connect member with a lateral pivot hole formed in a rear end, and each armrest supporter has a first connect member with a lateral pivot hole formed in an upper end of a vertical portion. A pivot extends in the lateral pivot holes of both the first and the second connect members to pivotally connect the armrest with the armrest supporter fixed with a side of a seat and a vertical side of a backrest. The armrest can be easily swung to a horizontal condition for the arm of a user to rest thereon or to a vertical condition if the armrest is not used.

7 Claims, 5 Drawing Sheets

21
5·22·12
11
1

23
24
13
5·22·12
4
14·25
2
1
3

OFFICE CHAIR ARMREST DEVICE

BACKGROUND OF THE INVENTION

This invention relates to an office chair armrest, particularly to one possible to be adjusted to become horizontal or vertical according to user's need.

Most conventional office chairs generally have armrests fixed stationary or movable in various directions with some device. Some armrests are pivotally connected with armrest supporters to bend up when necessary. However their structure is rather complicated having many components, resulting in high cost.

SUMMARY OF THE INVENTION

This invention has been devised to offer an armrest device for office chairs of a simple structure, possible to be handled to become horizontal or vertical.

The feature of the invention is an armrest and an L-shaped armrest supporter fixed on a side of a seat and a vertical side of a backrest. The armrest is pivotally connected to the armrest supporter so as to be swung to a horizontal condition or a vertical condition for use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
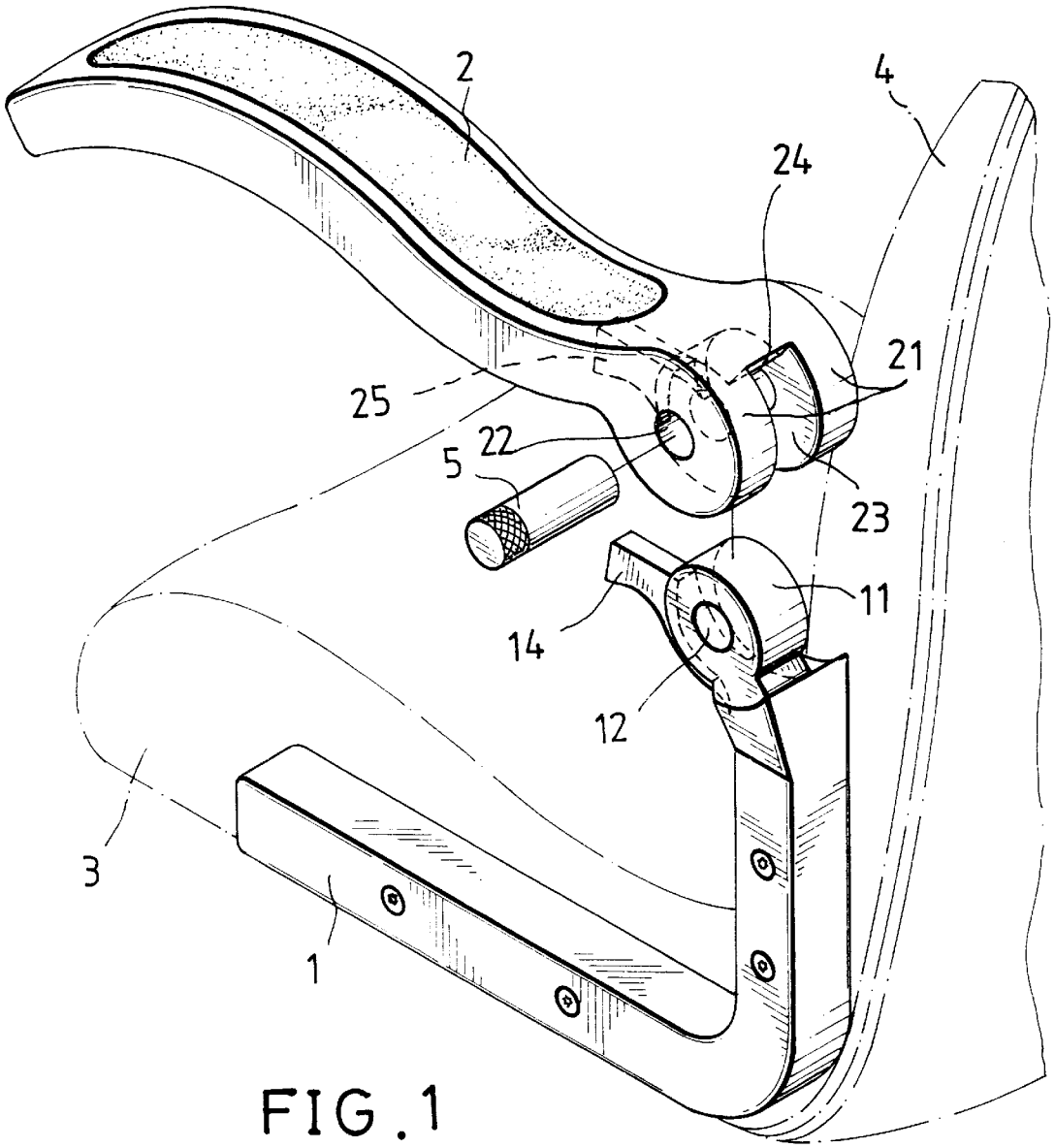
FIG. 1 is an exploded perspective view of an office chair armrest device in the present invention.

A preferred embodiment of an office chair armrest device in the present invention, as shown in FIG. 1, includes two L-shaped armrest supporters 1 and two armrests 2 combined together.

The two L-shaped armrest supporters 1 are fixed tightly on two opposite sides of a seat 3 and on two opposite lower sides of a backrest 4. Each armrest support 1 has a first connect member 11 formed in an upper end of a vertical portion, a lateral pivot hole 12 formed in the first connect member 11, a stop sloped surface 13 formed in a rear end of the first connect member 11, and an armrest prop member 14 formed to extend forward from the first connect member 11.

The two armrests 2 have a shape of a slow curve down to the front end if viewed from a side. Each armrest 2 has a second connect member 21 formed in a rear end and pivotally combined with the upper end of the first connect member 11 of the vertical portion of the L-shaped armrest supporter 1, a lateral pivot hole 22 formed in the second connect member 21, an aperture 23 formed in the middle section of the rear side of the second connect member 21 for the first connect member 11 to fit therein, a limit surface 24 formed on the bottom of the aperture 23, and a recess 25 formed to extend from the aperture 23 inward to be propped by the armrest prop member 14 of the armrest supporter 1.

Figure 2:
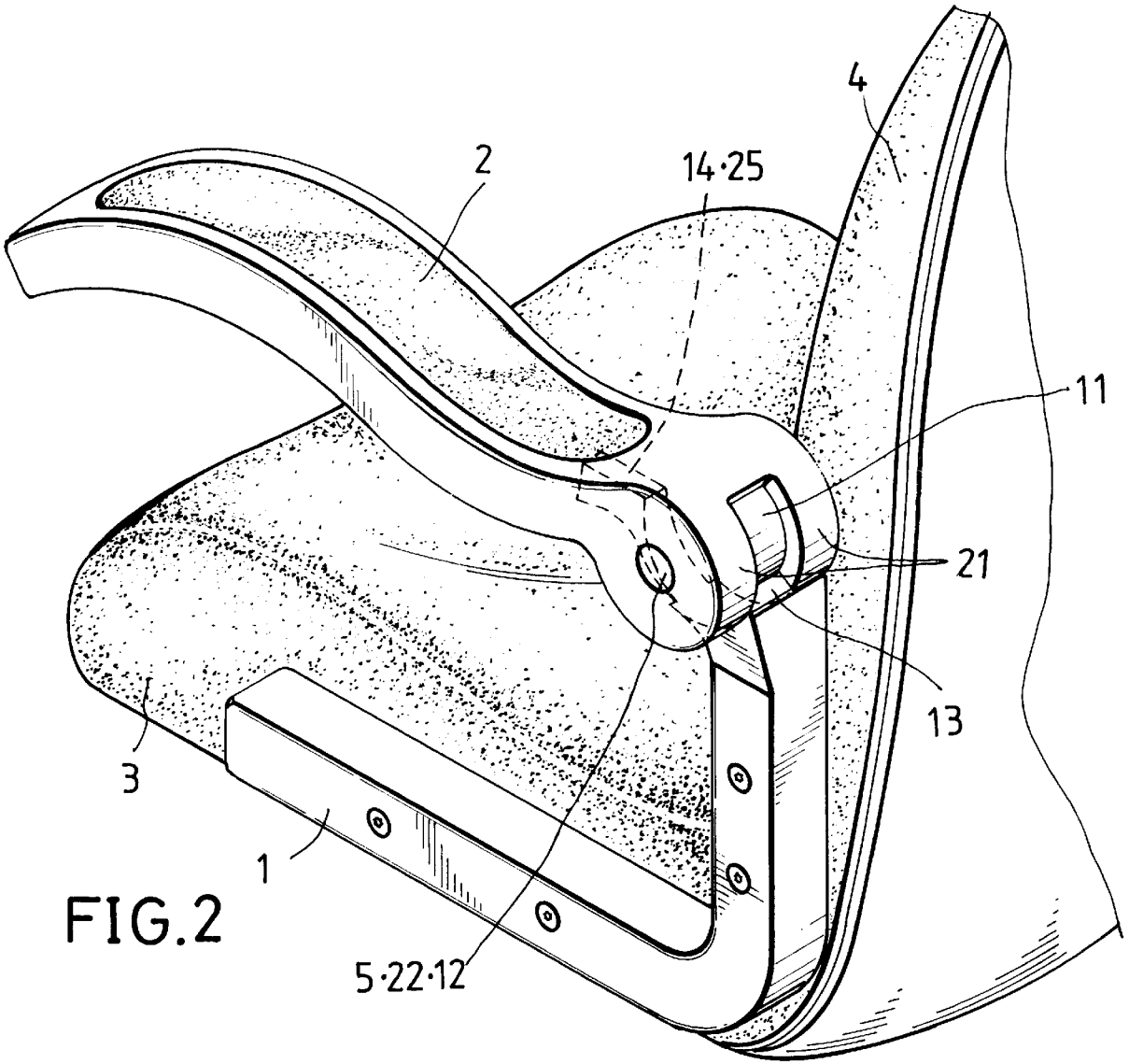
FIG. 2 is a perspective view of the office chair armrest device in the present invention.
Figures 3, 4:
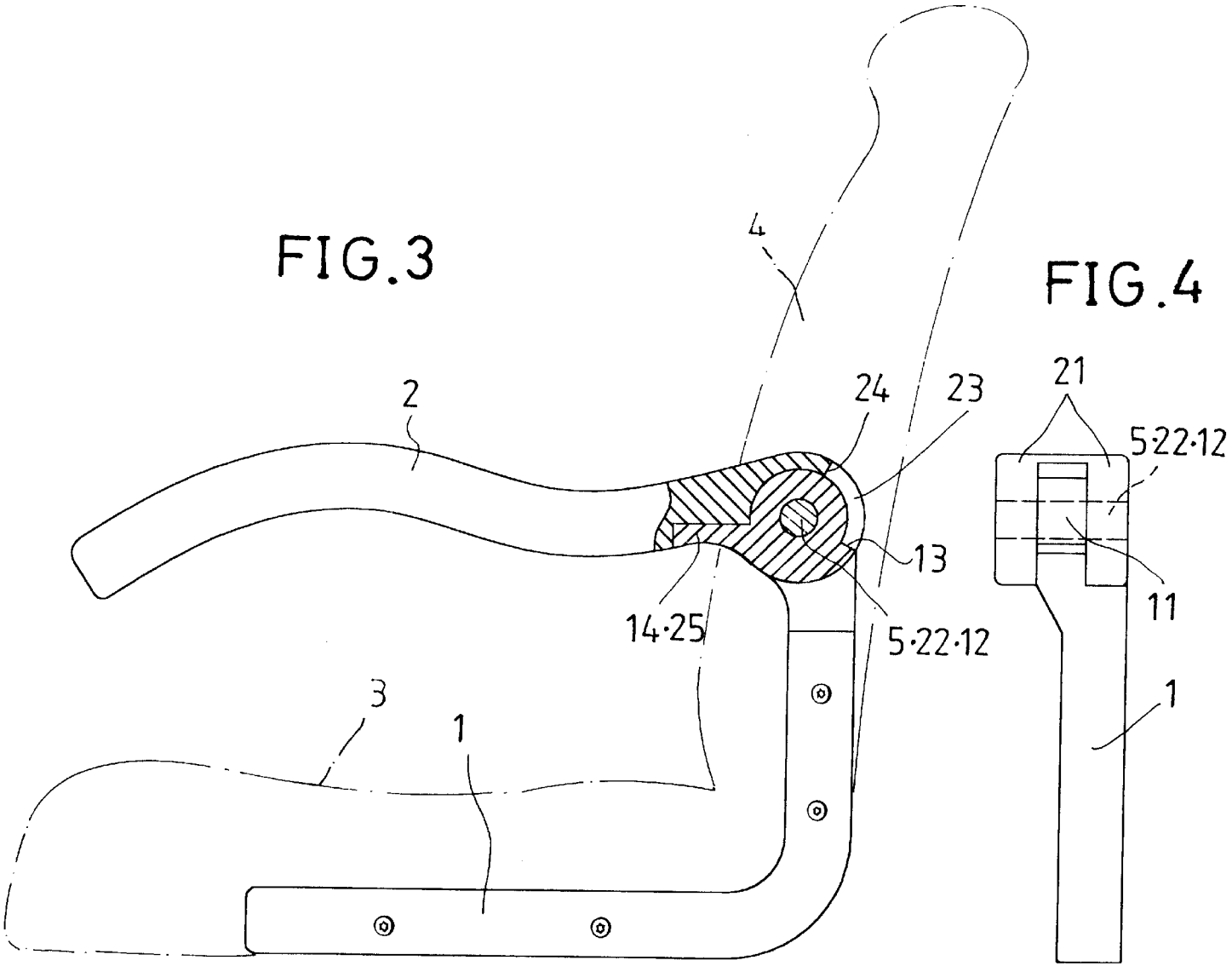
FIG. 3 is a side cross-sectional view of the office chair armrest device in the present invention.
FIG. 4 is an upper view of an armrest supporter of the office chair armrest device of the office chair armrest device in the present invention.
Figure 6:
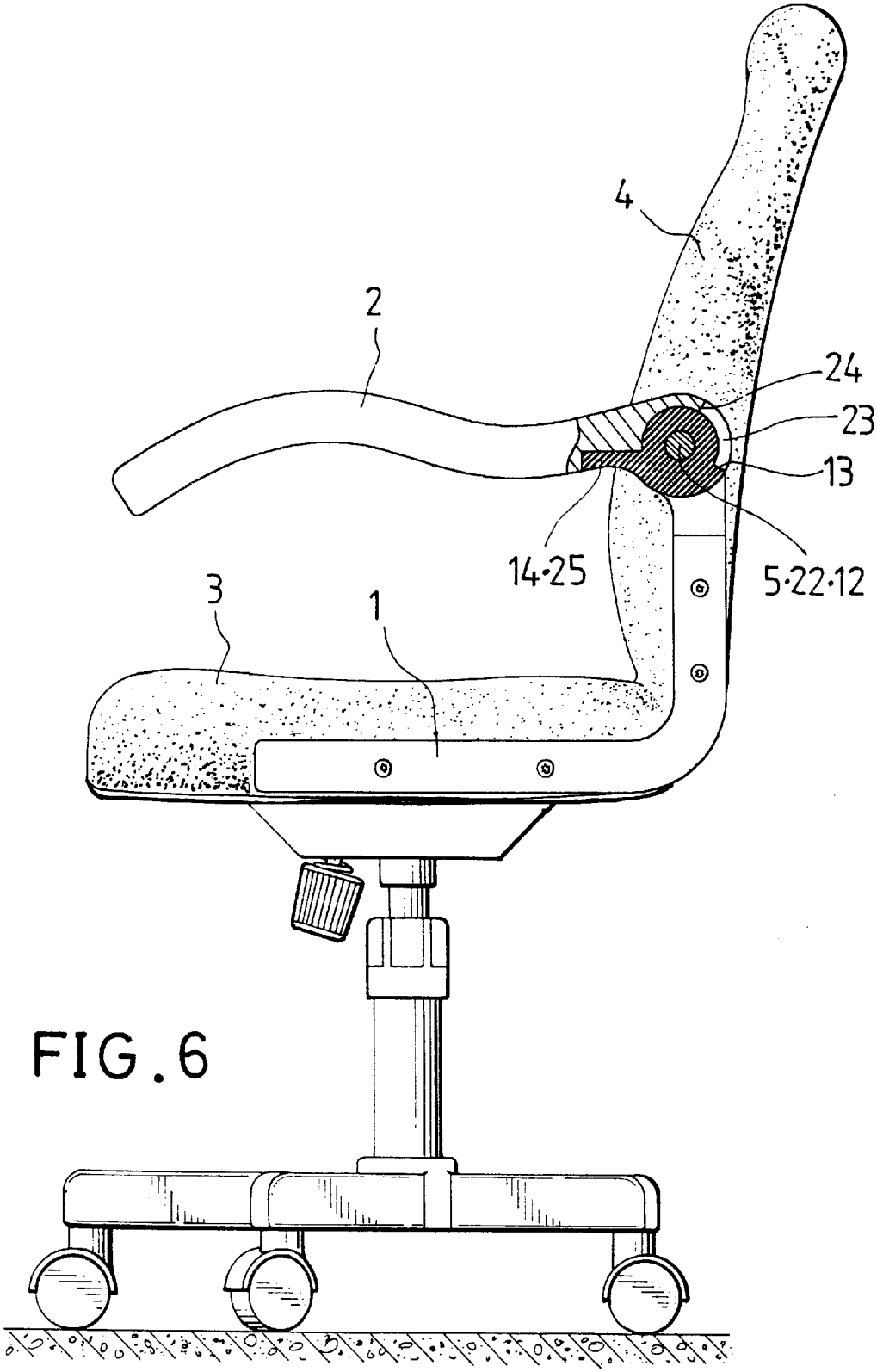
FIG. 6 is a cross-sectional view of the office chair armrest device fixed on an office chair in the present invention.

In assembling, as shown in FIGS. 2, 3 and 4, firstly, the second connect member 21 of the armrest 2 is combined with the first connect member 11 of the armrest supporter 1, with a pivot 5 inserted in the lateral pivot holes 22, 12 of both the second connect member 21 and first connect member 11, thus pivotally connecting the armrest supporter 1 with the armrest 2, as shown in FIG. 6.

Figure 5:
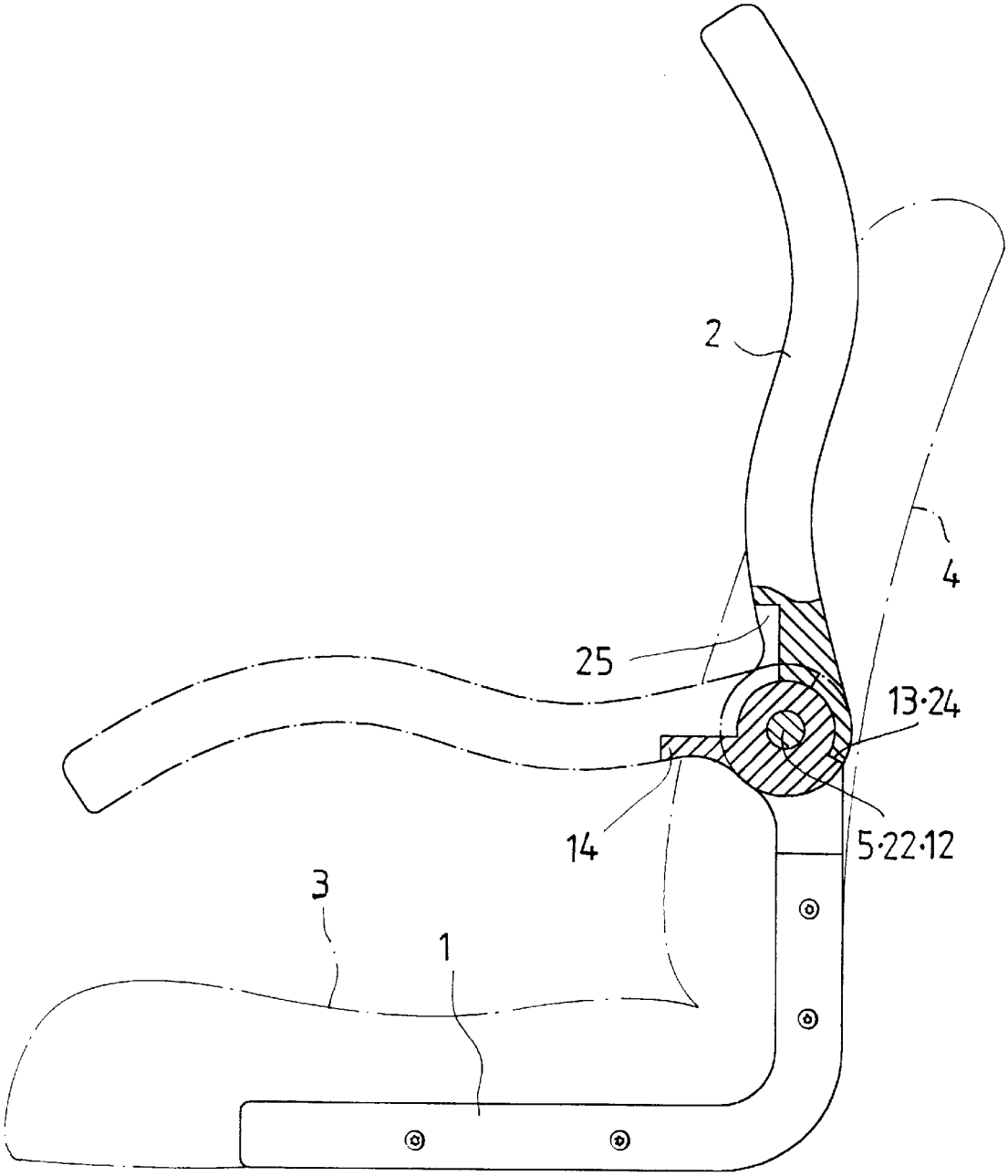
FIG. 5 is a side cross-sectional view of the office chair armrest device with the armrest swung to the vertical position in the present invention.

In use, the armrest 2 is normally swung down to be located in a horizontal condition as shown in FIG. 3 for receiving the arm of a sitter. In this position, the recess 25 of the armrest 2 is just propped by the armrest prop member 14, which supports the weight of the armrest 2 and the arm of the user. When the armrests 2 are not used or hamper the arms from movement, they can be swung up manually with a little force to the vertical condition as shown in FIG. 5, with the limit surface 24 of the armrest contacting and stopped by the stop sloped surface 13 so as to keep the armrest stable in the vertical condition.

The invention has the following advantages, as understood from the aforesaid description.

1. The armrest device has a simple structure to let makers manufacture with lower cost, enhancing market competitiveness.

2. The armrest device can be easily handled by a user to allow the armrest to be located in the horizontal condition for receiving the arm, and also to be swung up to the vertical condition if it is not used.

What is claimed is:

1. An office chair armrest device comprising, in combination:

an armrest supporter adapted to be fixed to an office chair, with the armrest supporter having a first connect member, a lateral pivot hole formed in said first connect member, a stop sloped surface formed in a rear side of said first connect member and an armrest prop member formed to extend horizontally outward from said first connect member;

an armrest having a second connect member formed in an inner end, a lateral pivot hole formed in said second connect member, an aperture formed in said second connect member and having a bottom, a limit surface formed on the bottom of said aperture, and a recess formed to extend inward from the bottom of said aperture so as to contact and be propped by said armrest prop member of said armrest supporter; and, said first connect member of said armrest supporter fitting in said aperture of said second connect member of said armrest, said pivot hole of said first and said second connect members aligned for a pivot to fit therein to pivotally connect said armrest supporter with said armrest to permit said armrest to swing up and down, said armrest prop member of said armrest supporter propping said recess of said armrest to support said armrest and the arm of a user when said armrest is in a horizontal condition, said armrest having its limit surface touching and stopped by said stop sloped surface of said armrest supporter when said armrest is manually swung up to a vertical condition if said armrest is not used or hampers the arm of the user from movement.

2. The office chair armrest device as claimed in claim 1, wherein said pivot extends with a proper tightness in said pivot holes of both said armrest and said armrest supporter to permit said armrest to swing smoothly.

3. The office chair armrest device as claimed in claim 2, wherein the armrest supporter is L-shaped and includes a vertical portion having an upper end, with the first connect member formed in the upper end, with the armrest supporter adapted to be fixed to a side of a seat and to a vertical lower side of a backrest of the office chair.

4. The office chair armrest device as claimed in claim 3, wherein the aperture is formed in a middle section of said second connect member and opens to a rear side of the second connect member, with the limit surface formed almost vertically.

5. The office chair armrest device as claimed in claim 1, wherein the armrest supporter is L-shaped and includes a vertical portion having an upper end, with the first connect member formed in the upper end, with the armrest supporter adapted to be fixed to a side of a seat and to a vertical lower side of a backrest of the office chair.

6. The office chair armrest device as claimed in claim 5, wherein the aperture is formed in a middle section of said second connect member and opens to a rear side of the second connect member, with the limit surface formed almost vertically.

7. The office chair armrest device as claimed in claim 1, wherein the aperture is formed in a middle section of said second connect member and opens to a rear side of the second connect member, with the limit surface formed almost vertically.

* * * * *